US010079459B2

(12) United States Patent
Cheng et al.

(10) Patent No.: US 10,079,459 B2
(45) Date of Patent: Sep. 18, 2018

(54) DETACHED POWER SUPPLY APPARATUS AND SHELVING SYSTEM HAVING SAME

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Dong Cheng, Zhejiang (CN); Jiangguo Dong, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/629,902

(22) Filed: Jun. 22, 2017

(65) Prior Publication Data

US 2017/0373449 A1 Dec. 28, 2017

(30) Foreign Application Priority Data

Jun. 22, 2016 (CN) ..... 2016 1 0465500

(51) Int. Cl.

| | |
|---|---|
| ***H01R 25/14*** | (2006.01) |
| ***H01R 13/518*** | (2006.01) |
| ***A47F 11/10*** | (2006.01) |
| ***H01R 13/24*** | (2006.01) |
| ***H01R 13/627*** | (2006.01) |
| *F21V 21/35* | (2006.01) |

(52) U.S. Cl.

CPC ..... *H01R 25/142* (2013.01); *A47F 11/10* (2013.01); *H01R 13/2478* (2013.01); *H01R 13/518* (2013.01); *H01R 13/6273* (2013.01); *H01R 25/145* (2013.01); *F21V 21/35* (2013.01); *H01R 13/2421* (2013.01)

(58) Field of Classification Search

CPC ..... H01R 13/6273; H01R 13/62736; H01R 25/142; H01R 25/14; F21V 21/35

See application file for complete search history.

(56) References Cited

U.S. PATENT DOCUMENTS

| | | | | |
|---|---|---|---|---|
| 3,523,269 A * | 8/1970 | Bissland | ..... | H01R 13/743 439/358 |
| 6,231,205 B1 * | 5/2001 | Slesinger | ..... | A47B 96/02 362/125 |
| 2001/0021602 A1 * | 9/2001 | Zanten | ..... | H01R 13/6275 439/358 |
| 2005/0112939 A1 * | 5/2005 | Grzegorzewska | ... | G02B 6/3825 439/534 |

(Continued)

*Primary Examiner* — Briggitte R Hammond

(74) *Attorney, Agent, or Firm* — Wang Law Firm, Inc.

(57) ABSTRACT

A shelving system having a detached power supply apparatus includes at least a hollow vertical shelf rail, at least a bus bar inserted into the vertical shelf rail, and at least a detached power supply apparatus inserted in the vertical shelf rail and electrically connected to the bus bar. Each of the vertical shelf rails includes at least a punched hole, and two locating protrudes. Each of the bus bar includes a slot, and two current conductors. The slot includes a carrier surface, and a track abutting surface. Each of the detached power supply apparatus passes through the punched hole and is inserted between the carrier surface and the track abutting surface. Each of the detached power supply apparatus includes two push-in resilient ball head plungers, a receiving surface, an abutting surface, and two reeds. The abutting surface is engaging with the track abutting surface.

10 Claims, 5 Drawing Sheets

(56) References Cited

U.S. PATENT DOCUMENTS

| | | | | |
|---|---|---|---|---|
| 2014/0370730 | A1* | 12/2014 | Flynn | H01R 25/14<br>439/122 |
| 2015/0024615 | A1* | 1/2015 | Lindblom | H01R 13/625<br>439/121 |
| 2015/0207266 | A1* | 7/2015 | Kellond | H01R 13/2421<br>439/372 |
| 2016/0104985 | A1* | 4/2016 | Ewing | A47F 3/001<br>211/26 |

* cited by examiner

DETACHED POWER SUPPLY APPARATUS AND SHELVING SYSTEM HAVING SAME

RELATED APPLICATION

This present application claims benefit of the Chinese Application, CN201610465500.1, filed on Jun. 22, 2016.

BACKGROUND

1. Technical Field

The present application relates to lighting equipments, and more particularly to a detached power supply apparatus and a shelving system having same.

2. Description of the Related Art

Light emitting diode (LED) is growing in popularity due to decreasing costs and long life compared to incandescent lighting and fluorescent lighting. Recently, a number of LED lighting apparatuses have been designed to replace the halogen apparatus, as well as other traditional incandescent or fluorescence lighting apparatuses. LED lightings also are used to shelf track lighting device. Shelves are used in very wide range, such as in shopping malls, logistics warehouses, factory warehouses, etc., which need shelves to place goods. For these shelves, lighting is necessary, especially in the mall, it has particularly high requirements of lighting, such as saving space, security, easy assembly, beautiful, and so on.

In the prior art, a power source for supplying electric power to the LED lighting mounted on the shelf irradiation surface is generally provided on the back of the shelf. Therefore, it is need to pass through wires from the shelf irradiation surface to the back of the shelf so as to electrically connect the LED lighting with the power source supply. On one hand, it has more and messy wires and is inconvenient to arrange the wires due to the above power supply method. As a result, it is not advantageous for maintenance and aesthetics. On the other hand, as the shelves are required to have a strong versatility to be able to place different kinds of goods, it is necessary to set different mounting position of the shelf boards, such as removing it or replacing it. A patent application, whose Chinese application number is CN201520163602.9, and title is a power supply system for shelf track lighting device, publics a shelves for solving the above problems. However, the power supply system is fixed on a support arm. As a result, it is not convenient sometimes. For example, when the shelving system needs to increase the lamps, no additional sockets can be used. Therefore, it cannot bring the user a random convenience.

Therefore, it is necessary to provide a detached power supply apparatus and a shelving system having same which makes it possible to meet these desires.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout two views.

DETAILED DESCRIPTION

The present application is illustrated by way of example and not by way of limitation in the figures of the accompanying drawings. It should be noted that references to "an" or "one" embodiment in this application are not necessarily to the same embodiment, and such references mean at least one.

Figure 1:
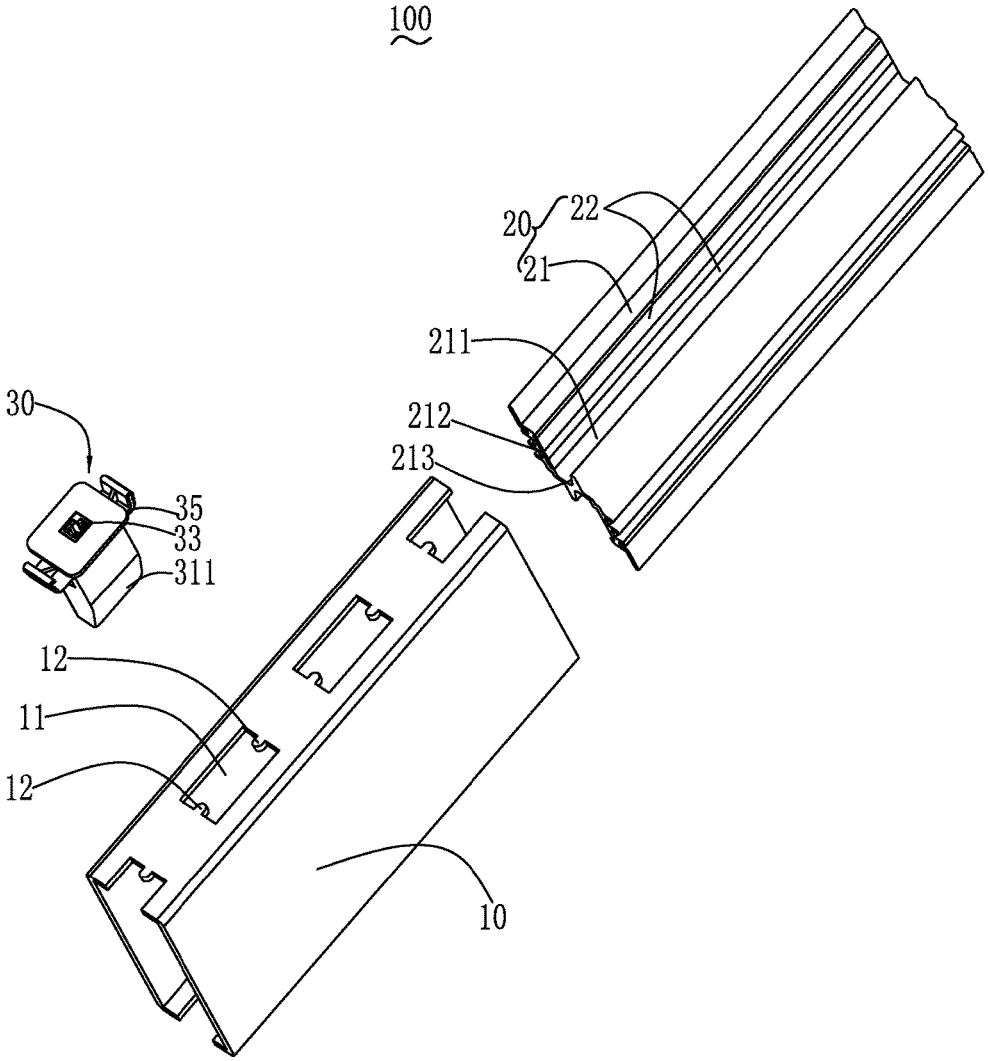
FIG. 1 is an exploded schematic view of a shelving system having a detached power supply apparatus according to an embodiment.
Figure 2:
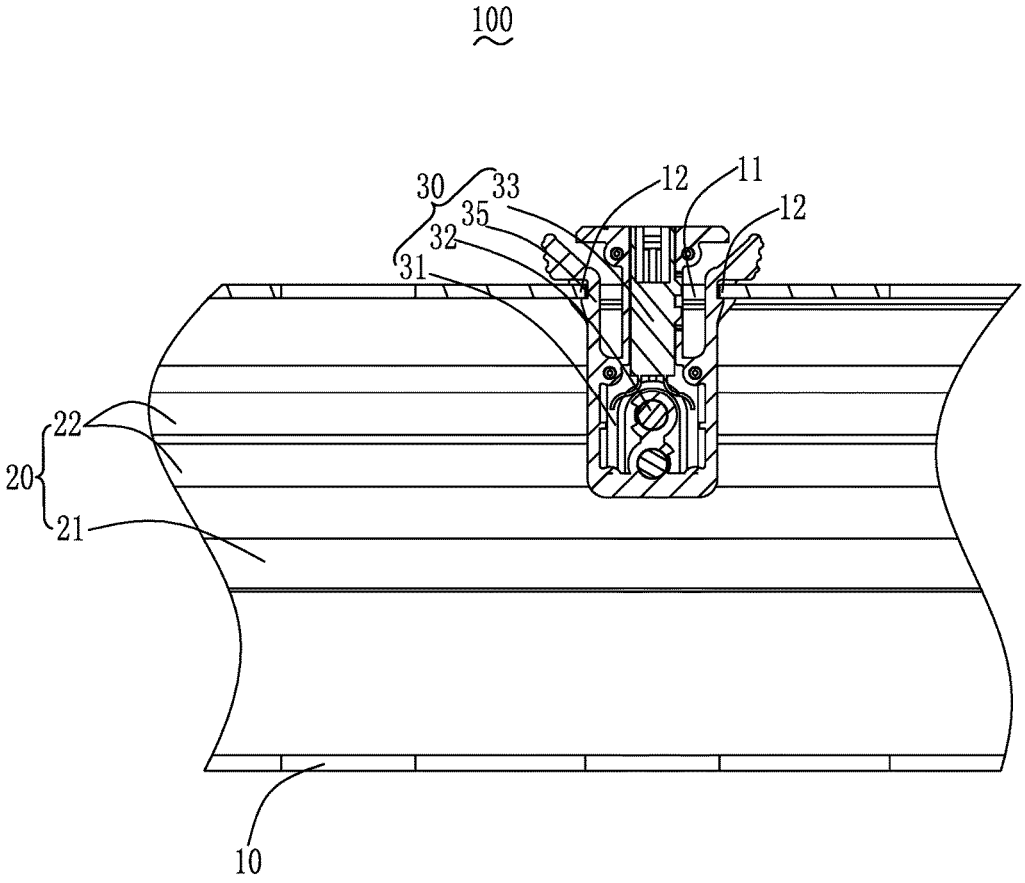
FIG. 2 is a cross section view of the shelving system of FIG. 1.

Referring to FIG. 1-FIG. 2, a shelving system 100 according to an embodiment are shown. The shelving system 100 includes a plurality of vertical shelf rails 10, a lot of bus bars 20 inserted in the vertical shelf rails 10 respectively, and a plurality of detached power supply apparatus 30 inserted on the vertical shelf rails 10. It can be understood that the shelving system 100 further includes some carrier elements, wires, support arms, backboards, and LED lightings mounted on the carrier elements, which are well known for a person skilled in the art and not described in detail.

The vertical shelf rail 10 is made of metal material and is a hollow rail having a rectangle cross-section. The vertical shelf rail 10 includes a plurality of punched holes 11, and a locating protrudes 12 provided on one side wall of the punched holes 11. The punched holes 11 have a rectangle shape and are opened along the extending direction of the vertical shelf rail 10 and spaced apart from each other. The locating protrudes 12 are disposed on a side wall of the punched holes 11 which is perpendicular to the extending direction of the vertical shelf rail 10. In order to make the vertical shelf rail 10 facilitate to use and no need to distinguish the upper and lower of the vertical shelf rail 10, two protrudes 12 are provided respectively two side walls of the vertical shelf rail 10 which are perpendicular to the extending direction thereof.

Figure 3:
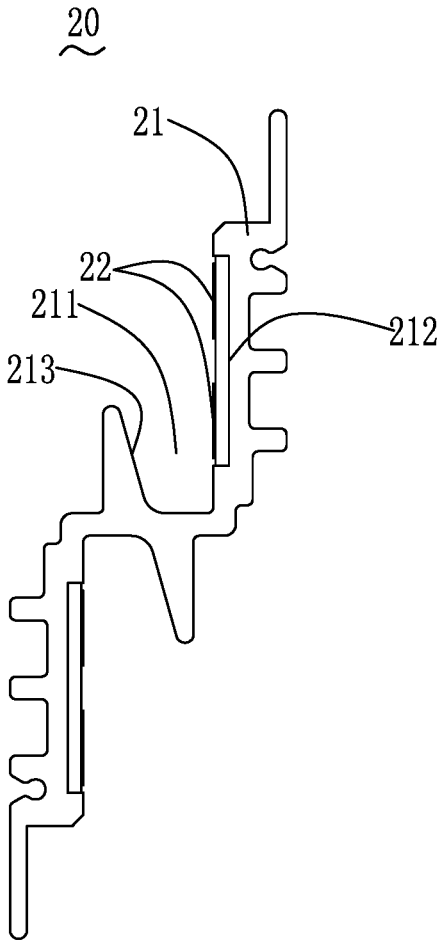
FIG. 3 is a cross section view of a bus bar of the shelving system of FIG. 1.

Referring to FIG. 3 together, the bus bar 20 passes through the hollow vertical shelf rail 10, and may have many. Each of the bus bars 20 is inserted into one of the vertical shelf rail 10 and includes a body 21, and two current conductors 22 spaced apart from each other. The body 21 provides a slot 211 opened thereon. The slot 211 includes a carrier plane 212 configured for mounting the current conductors 22, and a track abutting surface 213. The carrier plane 212 is designed in accordance with the structure feature of the detached power supply apparatus 30. When the detached power supply apparatus 30 is inserted into the slot 211, it will electrically connected to the current conductors 22 disposed on the carrier plane 212. The track abutting surface 213 is opposed to the mounting surface 212 so as to fix the relative position of the detached power supply apparatus 30. The track abutting surface 213 has a slope so that the width of the opening thereof is larger than the bottom portion thereof so as to facilitate to insert the detached power supply apparatus into the slot 211. It can be understood that it is possible that the backboards and the carrier elements are provided on both side of the vertical shelf rail 10. Therefore, the bus bars 20 are also symmetrically sized and fixed together to reduce costs. The current conductors 22 are insulated from each other and used to provide positive and negative power. Further, the two current conductors 22 are arranged vertically. That is to say, the two current conductors 22 are arranged along a length direction of the vertical shelf rail 10 so that the vertical shelf rail 10 cay supply power to the detached power supply apparatus 30 at an arbitrary position. In the present embodiment, the current conductors 41 is made of copper and are tiled on the same PCB (Printed Circuit Board) to be able to power LED lightings.

Figure 4:
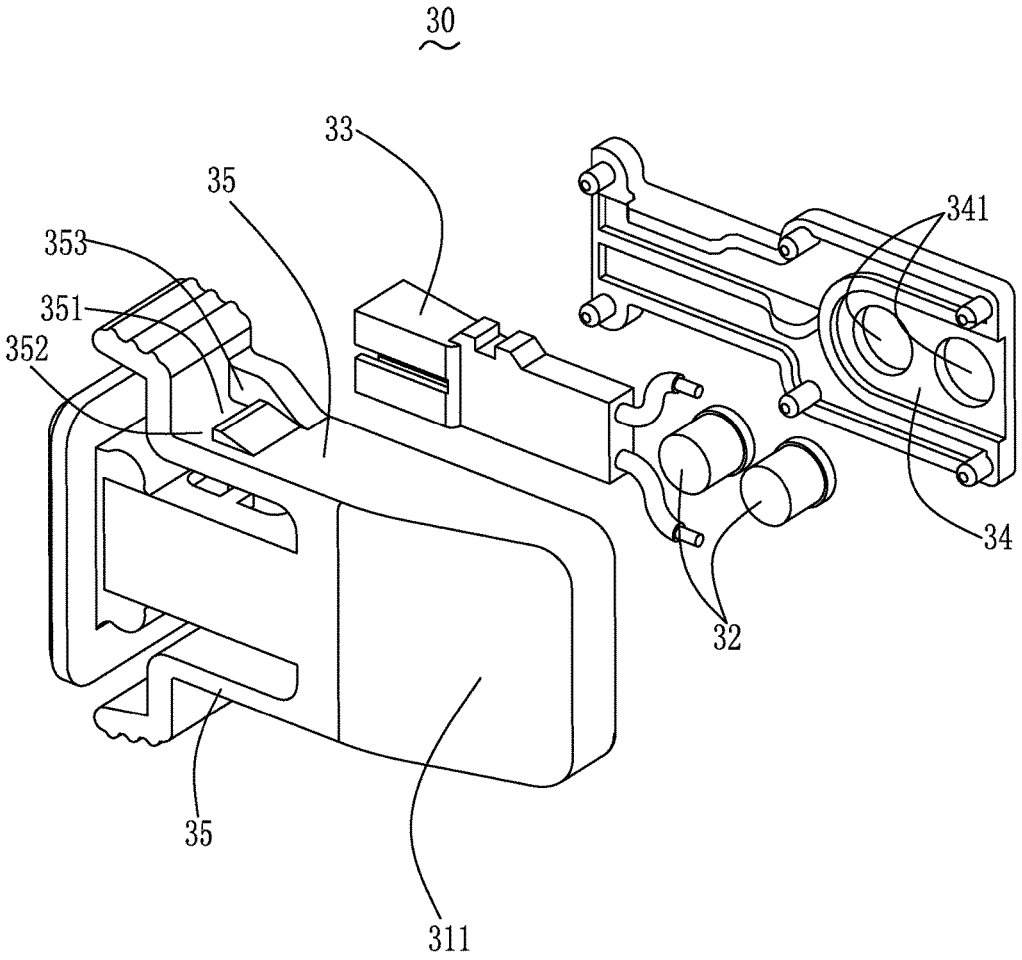
FIG. 4 is an exploded schematic view of a detached power supply apparatus according to an embodiment.
Figure 5:
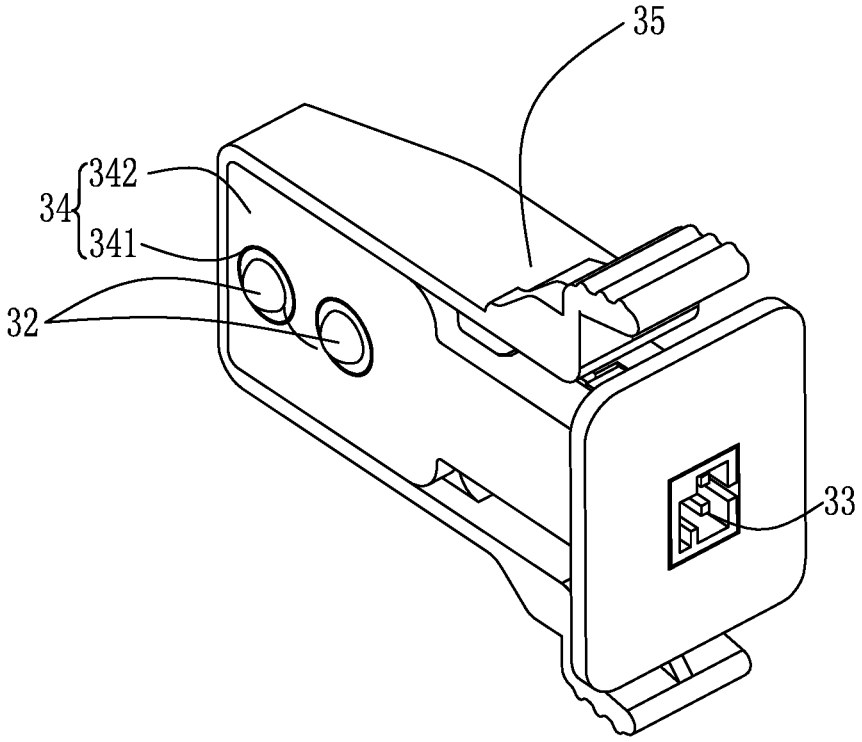
FIG. 5 is an isometric view of the detached power supply apparatus of FIG. 4.

Referring to FIG. 4 and FIG. 5, the detached power supply apparatus 30 may have many and is inserted in the punched hole 11. Each of the detached power supply apparatus 30 include a receiving chamber 31, two push-in resilient ball head plungers 32 spaced apart from each other and received in the receiving chamber 31, a socket 33 electrically connected to the two push-in resilient ball head plungers 32, a cover 34 covering the receiving chamber 31, and two reeds 35 disposed on an outer side of the receiving chamber 31. The receiving chamber 31 may be made of plastic by injection molding and is configured for receiving the push-in resilient ball head plungers 32 and the socket 33 and mounting the cover 34. One of the outer side walls of the receiving chamber 31 is abutted against the track abutting surface 213 of the bus bar 20 so as to avoid the two push-in resilient ball head plungers 32 and the current conductors 22 from being virtually connected. Since the track abutting surface 213 is a slope, the receiving chamber 31 also includes an abutting surface 311 and the abutting surface 311 is a slope so as to engage with the track abutting surface 213. The inclination direction of the abutting surface 311 is perpendicular to a receiving surface 342 described below, and inclination direction of the slope of the track abutting surface 213 is also perpendicular to the receiving surface 342. The two push-in resilient ball head plungers 32 are regarded as positive and negative electrical connecting pins and respectively electrically connected to the two current conductors 22. The push-in resilient ball head plunger is a standard part of the prior art and includes a semi-closed cylinder, a ball, and a spring sandwiched between the semi-closed cylinder and the ball. A diameter of the ball is larger than that of the mouth of the semi-closed cylinder so that the portion of the ball may be exposed to the mouth of the semi-closed cylinder and retracted in the semi-closed cylinder under the pressure of the external force. The socket 33 is also a standard member known to these skilled in the art and is used to electrically connect to the circuit board 321 for electrically connecting with a plug of LED lighting. The cover 34 is covered on the open of the receiving chamber 31 and includes two through holes 341 provided thereon so as to respectively allow the two push-in resilient ball head plungers 32 extend out of the cover 34. Because a side of the cover 34 is in contact with the current conductors 22 to make the two push-in elastic ball plungers 32 to electrically connect with the current conductors 22, the cover 34 includes the receiving surface 342 to mount the two push-in elastic ball plungers 32. As a result, the receiving surface 342, and the abutting surface 311 together form the receiving chamber 31. The two reeds 35 are respectively arranged on the two opposite sides of the receiving chamber 31 and located between the receiving surface 342 and the abutting surface 311. The elastic forces direction of the two reeds 35 are parallel to the receiving surface 342 and the abutting surface 311 so that the receiving surface 342 and the abutting surface 311 can be smoothly inserted into the slot 311 when the two reeds 35 are pressed down. When the detached power supply apparatus 30 is inserted into the punched hole 11, the two reeds 35 will be pressed down at the same time. Therefore, the maximum distance between the two reeds 35 in the normal state is larger than the distance between the two side walls of the punched hole 11 in which the locating protrudes 12 are disposed. Each of the two reeds 35 provides a limit groove 351. The limit groove 351 is configured for receiving part or all of the locating protrudes 12. In order to facilitate some or all of the locating protrudes 12 to be inserted into the limit groove 351, one end of the limit groove 351 has an opening 352 and the other end opposite the opening 352 has a closed end 353. When the detached power supply apparatus 30 is assembled into the shelving system 100, the two reeds 35 are firstly pressed down so that the locating protrudes 12 can be inserted into the limit groove 351 from the opening 352. Secondly, the two reeds 35 are released so that the two limit grooves 35 are respectively clipped onto the two locating protrudes 12 so as to prevent the detached power supply apparatus 30 from moving away from the bus bar 20. Moreover, due to the elastic force of the push-in resilient ball head plungers 32, the receiving surface 342 moves away from the carrier plane 212 of the bus bar 20. However, the receiving surface 342 can be prevented from moving away from the bus bar 20 due to the withstanding of the closed end 353. Furthermore, because of the location of the punched hole 11, the detached power supply apparatus 30 can be prevent from moving along the extending direction of the vertical shelf rail 10. As a result, the relative position of the detached power supply apparatus 30 is positioned in three-dimensional three directions so that the detached power supply apparatus 30 is stable and reliable.

As described above, the detached power supply apparatus 30 can be arbitrarily inserted in anyone of the punched holes 11 of the vertical shelf rail 10 of the shelving system 100 so as to satisfy the predetermined or temporary requirement of the user. As a result, the shelving system 100 having the detached power supply apparatus 30 has a greater versatility.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A detached power supply apparatus, comprising:

two push-in resilient ball head plungers spaced apart from each other;

a receiving surface for mounting the two push-in resilient ball head plungers;

an abutting surface opposite to the receiving surface; and two reeds spaced apart from each other and locating on two sides of the receiving surface and the abutting surface, the elastic force direction of the two reeds being parallel to the receiving surface and the abutting surface, each of the two reeds comprising a limit groove.

2. The detached power supply apparatus as claimed in claim 1, wherein the receiving surface, and the abutting surface together form a receiving chamber, the two push-in resilient ball head plungers are received in the receiving chamber.

3. The detached power supply apparatus as claimed in claim 2, wherein the detached power supply apparatus further comprises a socket, and the socket is mounted in the receiving chamber.

4. The detached power supply apparatus as claimed in claim 1, wherein the abutting surface comprises a slope along a direction perpendicular to the receiving surface.

5. The detached power supply apparatus as claimed in claim 1, wherein the limit groove comprises an opening opened one end thereof, and a closed end disposed in the other end thereof.

6. A shelving system having a detached power supply apparatus, comprising:

at least a vertical shelf rail, each of the vertical shelf rail comprising at least a punched hole, and two locating protrudes provided on two opposite side walls of each of the punched hole;

at least a bus bar inserted into the vertical shelf rail, each of the bus bar comprising a body, and two current conductors spaced apart from each other, the body providing a slot opened thereon, the slot comprising a carrier plane configured for mounting the current conductors, and a track abutting surface opposite to the carrier plane; and at least a detached power supply apparatus inserted in the vertical shelf rail and electrically connected to the bus bar, each of the detached power supply apparatus passing through the punched hole and being inserted between the carrier plane and the track abutting surface, each of the detached power supply apparatus comprising:

two push-in resilient ball head plungers spaced apart from each other;

a receiving surface for mounting the two push-in resilient ball head plungers;

an abutting surface opposite to the receiving surface; and two reeds spaced apart from each other and locating on two sides of the receiving surface and the abutting surface, the elastic force direction of the two reeds being parallel to the receiving surface and the abutting surface, each of the two reeds comprising a limit groove, the abutting surface being engaging with the track abutting surface, each of the limit groove being clipped into the locating protrude.

7. The shelving system as claimed in claim 6, wherein the two push-in resilient ball head plungers electrically connected to the two current conductors respectively.

8. The shelving system as claimed in claim 6, wherein the abutting surface comprises a slope along a direction perpendicular to the receiving surface, the track abutting surface also comprises a slope along the direction perpendicular to the receiving surface.

9. The shelving system as claimed in claim 6, wherein the maximum distance between the two reeds in the normal state is larger than the distance between the two side walls of the punched hole in which the locating protrudes 12 are disposed.

10. The shelving system as claimed in claim 6, wherein the limit groove comprises an opening opened one end thereof, and a closed end disposed in the other end thereof, the locating protrudes are coupled to the closed end.

* * * * *